US005880582A

United States Patent [19]

Sawada

[11] Patent Number: 5,880,582

[45] Date of Patent: Mar. 9, 1999

[54] CURRENT MIRROR CIRCUIT AND REFERENCE VOLTAGE GENERATING AND LIGHT EMITTING ELEMENT DRIVING CIRCUITS USING THE SAME

[75] Inventor: Sosaku Sawada, Yokohama, Japan

[73] Assignee: Sumitomo Electric Industries, Ltd., Osaka, Japan

[21] Appl. No.: 922,682

[22] Filed: Sep. 3, 1997

[30] Foreign Application Priority Data

Sep. 4, 1996 [JP] Japan ..... 8-233843

[51] Int. Cl.[6] ..... G05F 3/16

[52] U.S. Cl. ..... 323/315; 327/53

[58] Field of Search ..... 323/312, 313, 323/315; 327/53, 54, 55, 66

[56] References Cited

U.S. PATENT DOCUMENTS

| | | | |
|---|---|---|---|
| 4,069,460 | 1/1978 | Sauer | 327/53 |
| 4,653,029 | 3/1987 | Sato | 365/205 |
| 4,816,742 | 3/1989 | Van De Plassche | 323/314 |
| 4,864,539 | 9/1989 | Chuang et al. | 365/155 |
| 4,896,121 | 1/1990 | Larson . | |
| 4,994,688 | 2/1991 | Horiguchi et al. . | |
| 5,055,720 | 10/1991 | Tiede . | |
| 5,126,974 | 6/1992 | Sasaki et al. | 365/207 |
| 5,543,746 | 8/1996 | Kuo . | |

*Primary Examiner*—Matthew Nguyen
*Attorney, Agent, or Firm*—Pillsbury Madison & Sutro LLP

[57] ABSTRACT

A plurality of n-channel FETs in predetermined combinations are grouped two by two into pairs, and their respective gates and sources are connected to each other in a crossing manner, thus forming a first current mirror circuit connected to a higher-potential side power supply. A second current mirror circuit constituted by another plurality of n-channel FETs, diodes, and a variable resistor, which is connected to a lower-potential side power supply, is connected to the first current mirror circuit connected to the higher-potential side power supply, thereby forming a reference voltage generating circuit which generates a constant voltage. Further, three other pieces of n-channel FETs biased by this constant voltage, a diode, and the like constitute a light emitting element driving circuit for driving a light emitting element.

10 Claims, 4 Drawing Sheets

CURRENT MIRROR CIRCUIT AND REFERENCE VOLTAGE GENERATING AND LIGHT EMITTING ELEMENT DRIVING CIRCUITS USING THE SAME

BACKGROUND OF THE INVENTION

1. Field of the Invention

The present invention relates to a current mirror circuit composed of n-channel field effect transistors, and reference voltage generating and light emitting element driving circuits using this current mirror circuit.

2. Related Background Art

In an integrated circuit mainly composed of bipolar transistors such as those of ECL (Emitter Coupled Logic), the current flowing through the circuit is substantially determined by the base potential of the transistor connected to its lower-potential side power supply $V_{SS}$. This potential is generated by a reference voltage generating circuit, which is typically based on a current mirror circuit. Namely, as shown in FIG. 6, its higher-potential side power supply $V_{DD}$ is provided with a first current mirror circuit composed of a pair of PNP transistors Q1 and Q2, whereas the lower-potential side power supply $V_{SS}$ is provided with a second current mirror circuit composed of a pair of NPN transistors Q3 and Q4, in order to determine the base potential $V_B$ of the second current mirror circuit, i.e., reference potential $V_{REF}$, in response to the current $I_C$ determined by the first current mirror circuit.

In order for a circuit equivalent to that of FIG. 6 to be composed of field effect transistors (FETs), it has conventionally been necessary for a p-channel FET (p-FET) to be used in the first current circuit disposed on the side of the higher-potential side power supply $V_{DD}$.

The p-FET, however, has been disadvantageous in that it has inferior high-frequency characteristics and lower gain as compared with an n-channel field effect transistor (n-FET). Consequently, in order to secure a necessary current, a wider device area is required, thus making it difficult to improve the packaging density when n-FETs are integrated into a circuit, for example. Further, no p-channel Schottky field effect transistor (MESFET) has been realized yet, since it has not been able to raise the Schottky barrier between metals and p-type semiconductors.

In view of these problems, it is an object of the present invention to provide a current mirror circuit which is composed of n-channel field effect transistors and which can be connected to the side of a higher-potential side power supply. It is another object of the present invention to provide reference voltage generating and light emitting element driving circuits using this current mirror circuit.

SUMMARY OF THE INVENTION

The present invention provides a current mirror circuit composed of a plurality of n-FETs having identical characteristics, comprising a first FET pair in which respective sources and gates of two pieces of the n-FETs are connected to each other in a crossing manner, a higher-potential side power supply being connected to drains of both of them; and a second FET pair composed of two pieces of the n-FETs different from the first FET pair, whose respective sources and gates are connected to each other in a crossing manner, one of the n-FETs having a drain connected to the source of one of the FETs constituting the first FET pair, the other n-FET having a drain connected to the higher-potential side power supply; wherein the other n-FET of the first FET pair and the other n-FET of the second FET pair have source output currents identical to each other.

Also, the present invention provides a current mirror circuit including 2×m sets (m being a natural number not smaller than 2) of FET pairs each combining together two pieces of a plurality of n-FETs having identical characteristics such that respective sources and gates thereof are connected to each other in a crossing manner; m sets of the FET pairs constituting each of first and second groups of FET pair series; each of the n-FETs in the first group of FET pair series having a drain connected to a higher-potential side power supply; whereas, in the second group of FET pair series, a first n-FET of an i-th ($1 \leqq i \leqq m-1$) set of the FET pair having a drain connected to the source of a second n-FET of the i-th set of FET pair in the first group of FET pair series, the second n-FET thereof having a drain connected to the source of the first n-FET of an (i+1)-th set of FET pair in the first group of FET pair series, the first n-FET of an m-th set of FET pair having a drain connected to the source of the second n-FET of the m-th set of FET pair in the first group of FET pair series, the second n-FET thereof having a drain connected to the source of the first n-FET of the first set of FET pair in the first group of FET pair series, thus forming a circular path; wherein all of the m pieces of the first n-FETs in the second group of FET pair series have source output currents identical to each other, and all of the m pieces of the second n-FETs in the second group of FET pair series have source output currents identical to each other.

The present invention provides a reference voltage generating circuit comprising the above-mentioned (first) current mirror circuit (m=2); and a second current mirror circuit composed of two pieces of n-FETs having characteristics identical to each other, each piece having a commonly-connected gate, a source connected to a lower-potential side power supply, and a drain connected to the source of the first or second n-FET of the first current mirror circuit, wherein a reference voltage is generated at the commonly-connected gate of the second current mirror circuit.

On the other hand, the present invention provides a light emitting element driving circuit comprising the above-mentioned reference voltage generating circuit; a light emitting element; a differential circuit composed of two pieces of n-FETs having characteristics identical to each other, commonly-connected sources, gates receiving complementary signals, and drains, the drain of one of the n-FETs being connected to a higher-potential side power supply by way of the light emitting element, whereas the drain of the other n-FET being connected to the higher-potential side power supply; and an n-FET having a gate held at the reference voltage, a source connected to a lower-potential side power supply, and a drain connected to the commonly-connected sources of the differential circuit, wherein the complementary signals control an on/off operation of the light emitting element.

Here, each of the n-FETs constituting their corresponding circuits may be a Schottky field effect transistor containing GaAs as its channel material.

Such a configuration can provide a current mirror circuit which is composed of n-channel field effect transistors and can be applied to a higher-potential side power supply, thereby allowing various circuits excellent in high-frequency characteristics and the like to be realized.

In the reference voltage generating circuit of the present invention, another current mirror circuit adapted for a lower-potential side power supply is connected to the current mirror circuit adapted for the higher-potential side power supply so as to operate in a current mode, thus making it possible to yield a constant reference voltage which is free from the influence of fluctuations and the like of these power supplies.

In the light emitting element driving circuit of the present invention, the electric power for driving the light emitting element is set on the basis of the reference voltage outputted from the reference voltage generating circuit using this current mirror circuit, whereby the light intensity at the time when the light emitting element emits light can be made constant, thus allowing high-grade optical communications and the like to be performed.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

Figure 1:
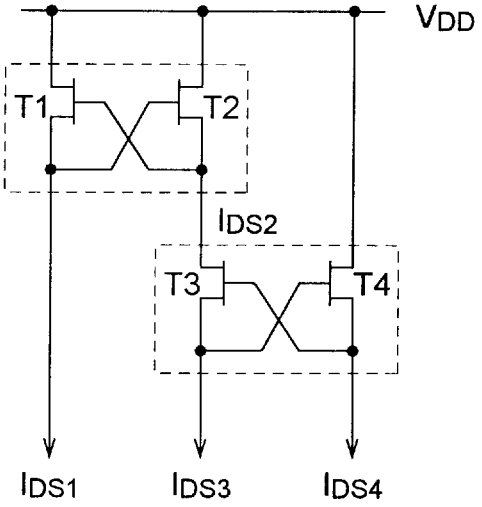
FIG. 1 is a circuit diagram showing a basic configuration of a current mirror circuit in accordance with an embodiment of the present invention.

A basic configuration of the current mirror circuit in accordance with the present invention which is shown in FIG. 1 will be explained with reference to this drawing.

This circuit is constituted by n-channel field effect transistors (each referred to as FET hereinafter) T1 to T4. Respective gates and sources of a pair of FETs T1 and T2 are connected to each other in a crossing manner, thereby forming a first FET pair. Namely, the gate of the FET T1 and the source of the FET T2 are connected to each other, and the gate of the FET T2 and the source of the FET T1 are connected to each other, thus constituting the first FET pair. Similarly, respective gates and sources of a pair of FETs T3 and T4 are connected to each other in a crossing manner, thereby forming a second FET pair. Further, drains of the FETs T1 and T2 are connected to a terminal of a higher-potential side power supply $V_{DD}$, while the source of the FET T2 is connected to the drain of the FET T3. Here, the FET T1 to T4 are n-channel field effect transistors all of which have characteristics identical to each other.

In the following, an operation of this current mirror circuit will be explained.

In general, in an FET, a bias voltage $V_{GS}$ applied between its gate and source and a current $I_{DS}$ flowing between its drain and source have a relationship given by the following equation:

$$I_{DS}=K\cdot(V_{GS}-V_{TH})^2$$

wherein K is a coefficient concerning a mutual conductance of the FET, and $V_{TH}$ is a threshold voltage level. Accordingly, assuming that the gate-source voltage of the FET T1 in the first FET pair is $V_{GS1}$, the current $I_{DS1}$ flowing through the drain of the FET T1 becomes:

$$\begin{aligned} I_{DS1} &= K\cdot(V_{GS1}-V_{TH})^2 \\ &= K\cdot(V_{GS1}^2+V_{TH}^2-2\cdot V_{GS1}\cdot V_{TH}) \\ &= I_0-\Delta I \end{aligned}$$

wherein:

$I_0=K\cdot(V_{GS1}{}^2+V_{TH}{}^2)$ $\Delta I=K\cdot 2\cdot V_{GS1}\cdot V_{TH}$ In the FET T2, on the other hand, since its gate and source are set to a bias condition totally opposite to that in the FET T1 in terms of polarity, the current $I_{DS2}$ flowing through the drain thereof can be expressed as:

$$\begin{aligned} I_{DS2} &= K\cdot(-V_{GS1}-V_{TH})^2 \\ &= K\cdot(V_{GS1}^2+V_{TH}^2+2\cdot V_{GS1}\cdot V_{TH}) \\ &= I_0+\Delta I \end{aligned}$$

Namely, respectively flowing through the drains of the FETs T1 and T2 are currents increased and decreased from the median $I_0=K\cdot(V_{GS1}{}^2+V_{TH}{}^2)$ by the current $\Delta I=K\cdot 2\cdot V_{GS1}\cdot V_{TH}$. The circuit of this FET pair constitutes a so-called inverting current mirror circuit. Further, since an inverting current mirror circuit similar to that mentioned above is formed in the FETs T3 and T4, a relationship similar to that mentioned above is established for the currents $I_{DS3}$ and $I_{DS4}$ flowing through the drains of the FETs T3 and T4, whereby currents increased and decreased from the median $I_0$ by $\Delta I$ respectively flow through these drains.

On the other hand, though the source of the FET T2 is connected to the drain of the FET T3 and the gate of the FET T1, since no current substantially flows into the gate of the FET T1, the whole current flowing out from the source of the FET T2 flows into the drain of the FET T3, thus establishing $I_{DS2}=I_{DS3}=I_0+\Delta I$. Hence, as can be seen from the above explanation, a current $(I_0-\Delta I)$ symmetrical thereto flows through the other FET T4 of the second FET pair, and this current $I_{DS4}$ is equal to the current $I_{DS1}$ flowing through its drain. Namely, the circuit configuration formed by the FETs T1 to T4 realizes a current mirror circuit which is connected to the higher-potential side power supply $V_{DD}$ and in which the currents $I_{DS1}$ and $I_{DS4}$ having current levels identical to each other serve as takeout currents.

Figure 2:
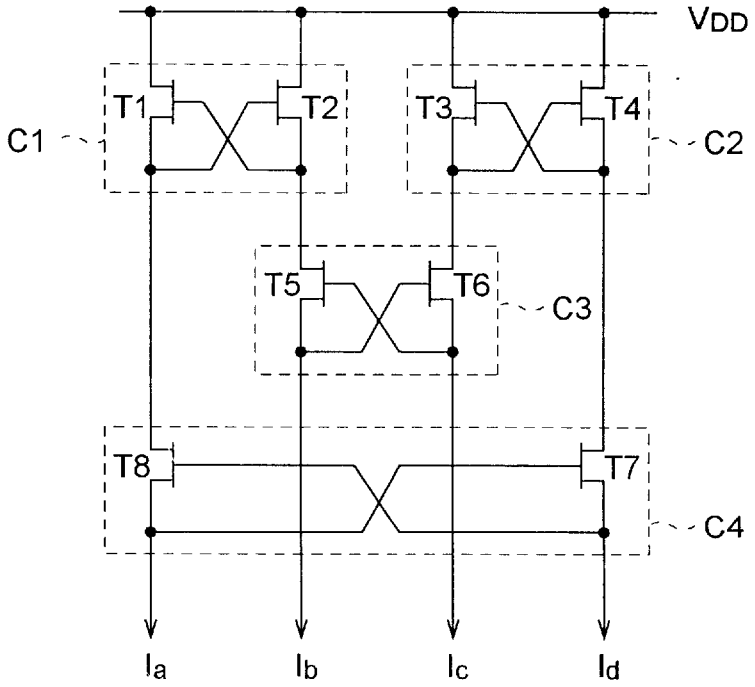
FIG. 2 is a circuit diagram showing another configuration of the current mirror circuit in accordance with an embodiment of the present invention.

FIG. 2 shows a circuit configured on the basis of the fundamental current mirror circuit shown in FIG. 1. This circuit comprises a first group of inverting current mirror circuits C1 and C2, while all of the drains constituting these circuits are connected to a terminal of the higher-potential side power supply $V_{DD}$. On the other hand, inverting current mirror circuits C3 and C4 in a second group are symmetrically connected to each of the inverting current mirror circuits C1 and C2 in the first group.

According to a theory similar to that concerning FIG. 1, takeout currents Ia to Id flowing through the inverting current mirror circuits C3 and C4 in the second group establish the following relationship:

$$Ia=Ic=I_0(\pm)\Delta I$$

$$Ib=Id=I_0(\pm)\Delta I$$

wherein the signs (±) of the current ΔI indicate that one of them becomes subtraction "−" when the other is addition "+." The relationship defined by the current levels of the above equations is established between the currents Ia and Ic and between the currents Ib and Id.

Though the current mirror circuit of this embodiment is constituted by four sets in total of inverting current mirror circuits comprising two sets each for the first and second groups, the present invention should not be restricted thereto. In general, when m sets (m being a natural number) of inverting current mirror circuits are used as the first group, while m sets of inverting current mirror circuits to which the first group is symmetrically connected are used as the second group, they can constitute a current mirror circuit having m pieces of output terminals with two kinds ($I_0+\Delta I$, $I_0-\Delta I$) of takeout current levels. Namely, connected to the source of one of the FETs constituting the i-th inverting current mirror circuit in the first group is the drain of one of the FETs constituting one of the inverting current mirror circuits in the second group, whereas connected to the drain of the other FET in the latter circuit is the source of the (i+1)-th inverting current mirror circuit in the first group. Such a connection is successively repeated until the drain of the other FET of the last, i.e., n-th, inverting current mirror circuit in the second group is connected to the source of the remaining FET of the initial, i.e., first, inverting current mirror circuit in the first group.

Figure 3:
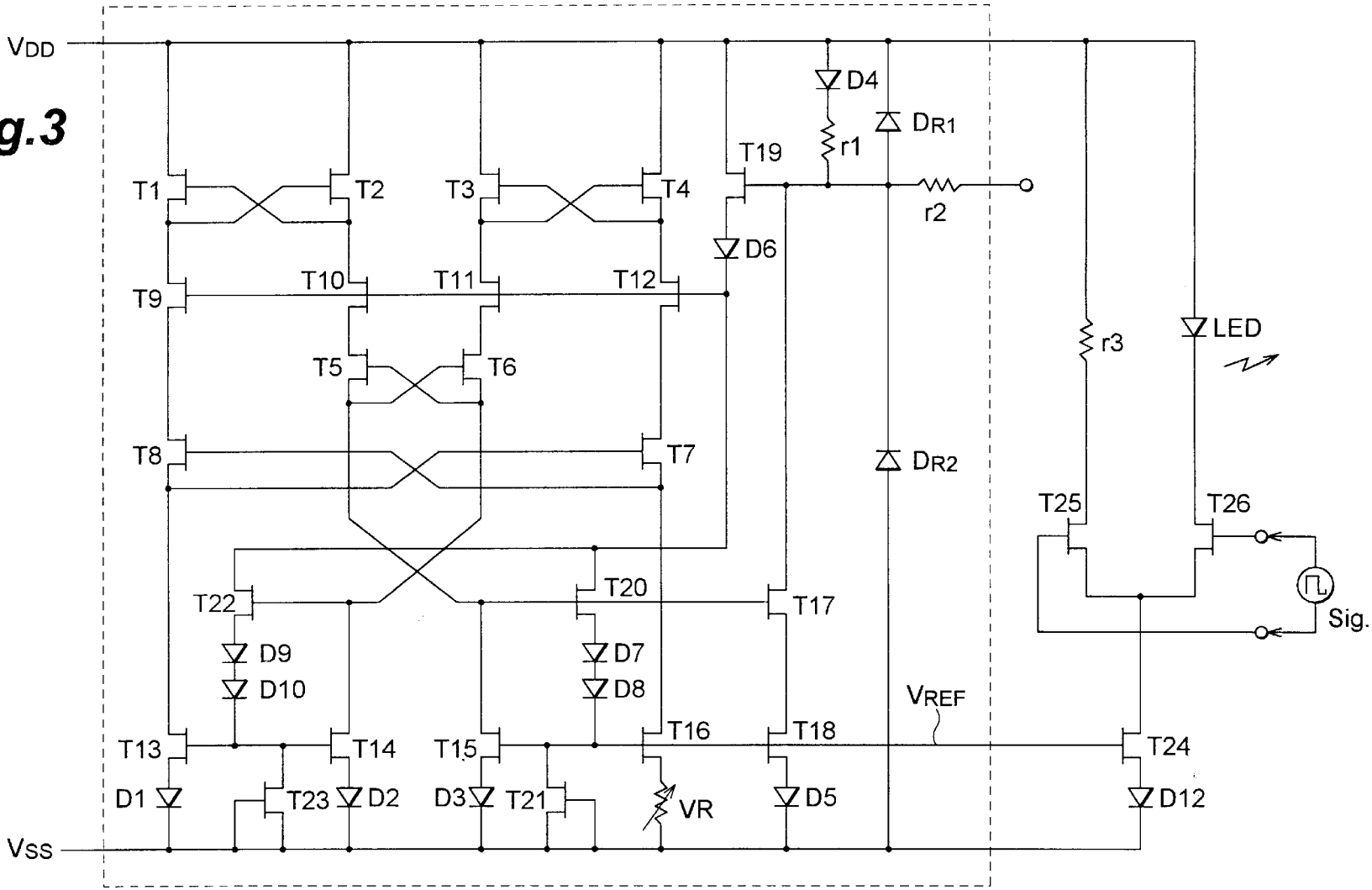
FIG. 3 is a circuit diagram showing a configuration of reference voltage generating and light emitting element driving circuits in accordance with an embodiment of the present invention.

In the following, an embodiment of reference voltage generating and light emitting element driving circuits employing the above-mentioned current mirror circuit will be explained with reference to FIG. 3. Here, FIG. 3 shows an overall configuration of the light emitting element driving circuit, whereas the reference voltage generating circuit is depicted as an area therein surrounded by dotted lines. Also, in this drawing, parts identical or equivalent to those in FIG. 1 or 2 are referred to with marks indicating the same.

The higher-potential side power supply $V_{DD}$ is provided with the current mirror circuit composed of the FET T1 to T8 shown in FIG. 2, which are n-channel field effect transistors with an identical specification. Nevertheless, unlike FIG. 2, FETs T9 to T12 are inserted in series into respective paths between the FETs T1 to T4 in the inverting current mirror circuits C1 and C2 of the first group and the FETs T5 to T8 in the inverting current mirror circuits C3 and C4 of the second group constituting this current mirror circuit. When a predetermined bias is applied to each of the gates of the FETs T9 to T12, the drain voltages of the FETs T5 to T8 can be restrained from changing. Accordingly, a highly accurate current mirror circuit can be realized.

The sources of the FETs T6 and T8, from which currents identical to each other can be taken out, are connected to respective drains of FETs T13 and T14 having an identical specification and constituting an FET pair. While the FETs T13 and T14 use their gates in common, their sources are connected to the lower-potential side voltage source $V_{SS}$ by way of diodes D1 and D2 which are biased forward.

On the other hand, the sources of the FETs T5 and T7, from which another set of identical currents can be taken out, are connected to respective drains of FETs T15 and T16 having an identical specification and constituting an FET pair. While the FETs T15 and T16 connect their gates in common, the sources of the FETs T15 and T16 are connected to the lower-potential side voltage source $V_{SS}$ respectively by way of a forward-biased diode D3 and a variable resistor VR. The commonly-connected gate potential defines the reference voltage $V_{REF}$.

Further provided is an FET T19 having a drain connected to the higher-potential side power supply $V_{DD}$ and a source connected to a forward-biased diode D6. The cathode of the diode D6 is connected to the gates of voltage-dropping FETs T9 to T12 and the drains of FETs T20 and T22. The source of the FET T20 is connected, by way of two diodes D7 and D8 which are biased forward and connected in series, to the drain of an FET T21, whose gate and source are short-circuited, operating as a pinch-off resistance. Also, as with the FET T20, diodes D9 and D10 and an FET T23 are connected to the FET T22. The gate of the FET T19 is connected to the higher-potential side voltage supply $V_{DD}$ and the drain of an FET T17 by way of a DC circuit composed of a forward-biased diode D4 and a resistor r1. The gate of the FET T17 is commonly connected to the gate of the FET T20, whereas the source of the FET T17 is connected to the lower-potential side power supply $V_{SS}$ by way of another FET T18 and a forward-biased diode D5. The gate of the FET T18 is commonly connected to the gates of the FETs T15 and T16.

The gate of the FET T19 is guided to an external terminal by way of a resistor r2. When a smoothing circuit composed of a capacitor and the like is connected to this external terminal, its potential can be restrained from fluctuating, thus yielding a higher resistance to noise. Reversely-biased diodes $D_{R1}$ and $D_{R2}$ inserted between this terminal and respective terminals of the power supplies $V_{DD}$ and $V_{SS}$ function as a static electricity protection circuit for protecting the gate of the FET T19 against surges.

Figure 4:
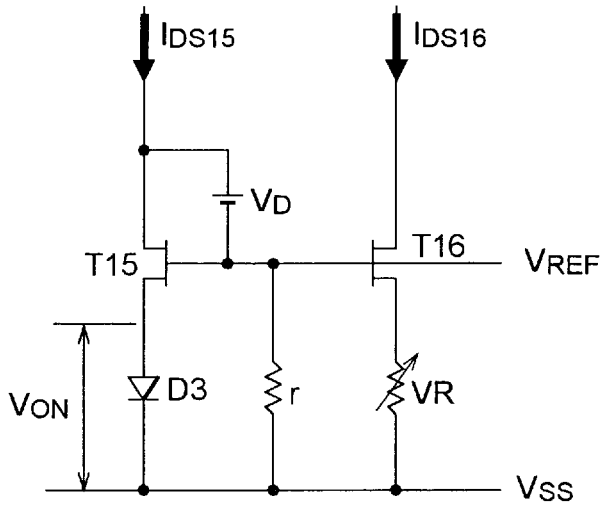
FIG. 4 is an explanatory view for explaining an operation of the reference voltage generating circuit in accordance with an embodiment of the present invention.

In the following, the principle of reference voltage generation in the present invention will be explained with reference to FIG. 4. Here, reference numbers for individual devices are based on those in FIG. 3. In FIG. 4, which extracts only the reference voltage generating circuit portion of FIG. 3, a device, which is constituted by the two n-channel field effect transistors FETs T15 and T16, the FET T20, and the diodes D7 and D8, inserted between the gate and drain of the FET T15 is simply represented by a voltage $V_D$, whereas the FET T21 serving as a pinch-off resistance is represented by a resistor r. The forward-biased diode D3 is connected to the source of the FET T15, whereas the variable resistor VR is connected to the source of the FET T16.

Currents $I_{DS15}$ and $I_{DS16}$ having current levels identical to each other respectively flow into the drains of the FETs T15 and T16 since they are respectively connected to the sources of the FETs T5 and T7 in the above-mentioned current mirror circuit. Also, since the FETs T15 and T16 use their gates in common, their source potentials must be identical to each other. The forward-biased diode D3 is connected to the source of the FET T15, whereby a voltage drop $V_{ON}$ is generated. On the other hand, the variable resistor VR is connected to the source of the FET T16, and the voltage drop occurring at both ends of this resistor VR must be equal to the $V_{ON}$. Consequently, according to the relationship of $I_{DS}=V_{ON}/R_{VR}$, the current $I_{DS}$ flowing through each of the two FETs T15 and T16 is determined. Here, $R_{VR}$ is the resistance value of the resistor VR.

Figure 5:
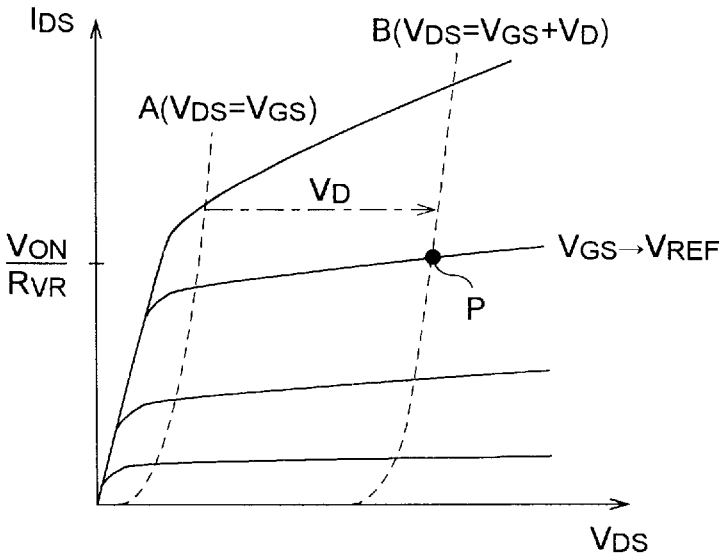
FIG. 5 is an explanatory view for further explaining the operation of the reference voltage generating circuit in accordance with an embodiment of the present invention.
Figure 6:
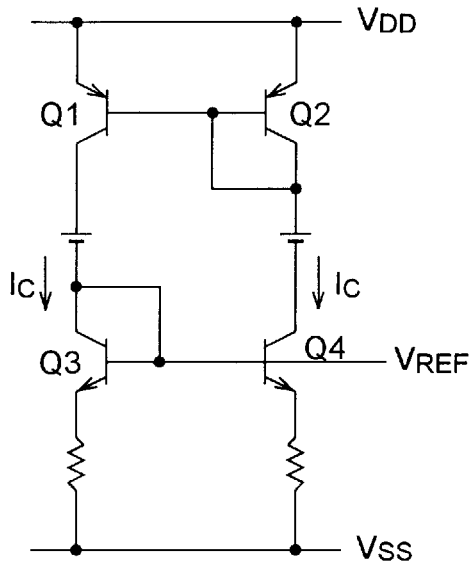
Fig.6 (PRIOR ART)
FIG. 6 is a circuit diagram showing a configuration of a conventional current mirror circuit.

The explanation will now be directed to the reference potential $V_{REF}$. Characteristics (static characteristics) of the drain current $I_{DS}$ with respect to the drain-source voltage $V_{DS}$ of the FETs T15 and T16 are represented by the continuous curves in FIG. 5. Since the FET T15 is connected, between its gate and drain, to the circuit constituted by the voltage $V_D$, its operating point is located on a dotted curve B which is shifted rightward by the voltage $V_D$ from a dotted curve A indicating $V_{DS}=V_{GS}$. Also, since currents which are identical to each other due to the effect of the current mirror circuit as being defined by $V_{ON}/R_{VR}$ flow into the respective drains of the FETs T15 and T16, the operating point is definitely set at a point of intersection P on the characteristic curve B where the drain current level is $V_{ON}/R_{VR}$. As a result, gate bias voltages $V_{GS15}$ and $V_{GS16}$ are determined as well. This operating point P is stabilized by the effects of the above-mentioned current mirror circuit and the feedback circuit inserted between the gate and drain of the FET T15, even when the common gate potential of the FETs T15 and T16 and the drain potential of the FET T15 tend to fluctuate due to a disturbance such as noise. The effect of this feedback circuit is also applicable to another FET pair composed of the FETs T13 and T14 connected to the above-mentioned current mirror circuit. In this case, though no variable resistor is connected to one source of the FET pair, the level of identical currents flowing through the FETs T15 and T16 can be determined when the value $R_{VR}$ of the variable resistor VR is changed. On the other hand, currents having a complementary relationship to this current level in the current mirror circuit flow into the circuit of the FET pair made of the FETs T13 and T14. Consequently, the levels of currents flowing into the FETs T13 to T16 can be controlled by the single variable resistor VR.

The remaining circuit devices are provided in order to apply appropriate bias voltages to the FETs T9 to T12 and the FETs T20 and T22.

In the following, the light emitting element driving circuit will be explained.

The potential $V_{REF}$ generated by the above-mentioned reference voltage generating circuit is guided to the gate of an FET T24, whose source is connected to the lower-potential side power supply $V_{SS}$ by way of a forward-connected diode D12. The drain of the FET T24 is connected to the common source of FETs T25 and T26 constituting a differential FET pair, whereas the drain of the FET T25 is connected to the higher-potential side power supply $V_{DD}$ by way of a resistor r3. On the other hand, a light emitting element (light emitting diode: LED) is connected between the drain of an FET T26 and the higher-potential side power supply $V_{DD}$.

When the electric characteristics of the FET T24, to which the reference potential $V_{REF}$ is connected, and the diode D12 connected to its source satisfy a relationship similar to those of the FET T15 and diode D3 in the above-mentioned reference voltage generating circuit, a constant current defined by the reference voltage generating circuit can be caused to flow into the drain of the FET T24. For example, when the gate width $W_{G24}$ of the FET T24 is set at M times that of the gate width $W_{G15}$ of the FET T15, and the area of the diode D12 is set at M times that of the diode D3, the current $I_{DS24}$ flowing through the FET T24 can become M times that of the current level $I_{DS}$ flowing through the above-mentioned current mirror circuit, which is determined by the variable resistor VR.

The current $ID_{S24}$ is the sum of the currents flowing through FETs T25 and T26. When binary logic signals complementary to each other are fed into the gates of this differential FET pair, the resulting situation can be such that one of the FETs is turned on, whereas the other FET is turned off. Namely, the current $I_{DS24}$ can be alternately supplied to the FETs T25 and T26. Accordingly, for example, when logically "1" and "0" signals are respectively fed to the FETs T26 and T25, almost all the current $I_{DS24}$ flows through the FET T26, thus causing the light emitting element LED to emit light. By contrast, when logically "0" and "1" signals are respectively fed to the FETs T26 and T25, almost all the current $I_{DS24}$ can flow through the FET T25 and the resistor r3, whereby the light emitting element LED is turned off.

The emission intensity of the light emitting element LED is determined by the current $I_{DS24}$. The current $I_{DS24}$ depends only on the reference potential $V_{REF}$ by way of the FET T24 and can be changed by the variable resistor VR of the above-mentioned reference voltage generating circuit alone. Also, as can be seen from the above-mentioned theory, this potential $V_{REF}$ is hardly influenced by voltage fluctuations, noise, and the like of the power supplies $V_{DD}$ and $V_{SS}$. Once the resistance value $R_{VR}$ of the variable resistor VR is set, the current $I_{DS24}$ becomes constant thereafter, whereby the light emitting element LED can emit light quite stably.

This light emitting element driving circuit is advantageous in that a current level similar to a reference current can be set merely by means of devices T24 and D12 which are respectively similar to the devices T15 or T16 and D3 used in the reference voltage generating circuit. Accordingly, though this feature is applied to a circuit for driving a light emitting element in the present invention, without being restricted thereto, it is also applicable to differential amplifiers, differential logic circuits, and general amplifier circuits, for example. Namely, different operating currents at various blocks in a single integrated circuit can be defined when coefficients of similarity of devices corresponding to the FET T24 and the diode D12 are changed with respect to the reference voltage $V_{REF}$. Consequently, the current consumption of the whole circuit can be set easily.

Here, in order to constitute the current mirror circuit and reference voltage generating and light emitting element driving circuits of the present invention, various n-channel field effect transistors can be employed. For example, when a Schottky field effect transistor (GaAS-MESFET) containing gallium arsenide (GaAs) as its channel material is used as the n-channel field effect transistor (FET), various excellent effects such as improved high-frequency characteristics in the field of optical communications can be obtained.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No.8-233843 (233843/1996) filed on Sep. 4, 1996 is hereby incorporated by reference.

What is claimed is:

1. A current mirror circuit composed of a plurality of n-FETs having identical characteristics, said current mirror circuit comprising:

a first FET pair in which respective sources and gates of two pieces of said n-FETs are connected to each other in a crossing manner, a higher-potential side power supply being connected to drains of both of said two pieces; and a second FET pair composed of two pieces of said n-FETs different from said first FET pair, whose respective sources and gates are connected to each other in a crossing manner, one of said n-FETs having a drain connected to the source of one of the FETs constituting said first FET pair, the other n-FET having a drain connected to said higher-potential side power supply;

wherein the other n-FET of said first FET pair and the other n-FET of said second FET pair have source output currents identical to each other.

2. A current mirror circuit according to claim 1, wherein each n-FET constituting said circuit is a Schottky FET containing GaAs as a channel material thereof.

3. A current mirror circuit including 2×m sets (m being a natural number not smaller than 2) of FET pairs each combining together two pieces of a plurality of n-FETs having identical characteristics such that respective sources and gates thereof are connected to each other in a crossing manner;

m sets of the FET pairs constituting each of first and second groups of FET pair series;

each of the n-FETs in said first group of FET pair series having a drain connected to a higher-potential side power supply;

whereas, in said second group of FET pair series, a first n-FET of an i-th ($1 \leqq i \leqq m-1$) set of FET pair having a drain connected to the source of a second n-FET of the i-th set of FET pair in said first group of FET pair series, the second n-FET thereof having a drain connected to the source of the first n-FET of an (i+1)-th set of FET pair in said first group of FET pair series, the first n-FET of an m-th set of FET pair having a drain connected to the source of the second n-FET of the m-th set of FET pair in said first group of FET pair series, the second n-FET thereof having a drain connected to the source of the first n-FET of the first set of FET pair in said first group of FET pair series, thus forming a circular path;

wherein all of the m pieces of the first n-FETs in said second group of FET pair series have source output currents identical to each other, and all of the m pieces of said second n-FETs in said second group of FET pair series have source output currents identical to each other.

4. A current mirror circuit according to claim 3, wherein m is 2.

5. A current mirror circuit according to claim 3, wherein each n-FET constituting said circuit is a Schottky FET containing GaAs as a channel material thereof.

6. A current mirror circuit according to claim 5, wherein m is 2.

7. A reference voltage generating circuit comprising:

a first current mirror circuit constituted by the current mirror circuit according to claim 4; and a second current mirror circuit composed of two pieces of n-FETs having characteristics identical to each other, each piece having a commonly-connected gate, a source connected to a lower-potential side power supply, and a drain connected to the source of said first or second n-FET of said first current mirror circuit;

wherein a reference voltage is generated at the commonly-connected gate of said second current mirror circuit.

8. A reference voltage generating circuit according to claim 7, wherein each n-FET constituting said circuit is a Schottky FET containing GaAs as a channel material thereof.

9. A light emitting element driving circuit comprising:

the reference voltage generating circuit according to claim 7;

a light emitting element;

a differential circuit composed of two pieces of n-FETs having characteristics identical to each other, commonly-connected sources, gates receiving complementary signals, and drains, the drain of one of said n-FETs being connected to a higher-potential side power supply by way of said light emitting element, whereas the drain of the other n-FET being connected to said higher-potential side power supply; and an n-FET having a gate held at said reference voltage, a source connected to a lower-potential side power supply, and a drain connected to the commonly-connected sources of said differential circuit;

wherein said complementary signals control an on/off operation of said light emitting element.

10. A light emitting element driving circuit according to claim 9, wherein each n-FET constituting said circuit is a Schottky FET containing GaAs as a channel material thereof.

* * * * *